US010439263B2

(12) United States Patent
Schöninger

(10) Patent No.: US 10,439,263 B2
(45) Date of Patent: Oct. 8, 2019

(54) HIGH-FREQUENCY CONDUCTOR SYSTEM WITH CABLE-BOUND RF BUSHING

(71) Applicant: KATHREIN Mobilcom Austria GmbH, Niederndorf (AT)

(72) Inventor: Bernd Schöninger, Kufstein (AT)

(73) Assignee: Kathrein Mobilcom Austria GmbH, Niederndorf (AT)

( * ) Notice: Subject to any disclaimer, the term of this patent is extended or adjusted under 35 U.S.C. 154(b) by 75 days.

(21) Appl. No.: 15/556,538

(22) PCT Filed: May 10, 2016

(86) PCT No.: PCT/EP2016/060413

§ 371 (c)(1),
(2) Date: Sep. 7, 2017

(87) PCT Pub. No.: WO2016/188733

PCT Pub. Date: Dec. 1, 2016

(65) Prior Publication Data

US 2018/0053979 A1 Feb. 22, 2018

(30) Foreign Application Priority Data

May 22, 2015 (DE) ..... 10 2015 006 739

(51) Int. Cl.
*H01P 1/202* (2006.01)
*H01P 3/06* (2006.01)
(Continued)

(52) U.S. Cl.
CPC ..... *H01P 1/202* (2013.01); *H01P 3/06* (2013.01); *H01R 13/025* (2013.01); *H01R 24/40* (2013.01)

(58) Field of Classification Search
CPC ..... H01P 1/202; H01P 3/06
(Continued)

(56) References Cited

U.S. PATENT DOCUMENTS 3,688,224 A 8/1972 Suetake et al.
6,570,472 B1 5/2003 Niiranen
(Continued)

FOREIGN PATENT DOCUMENTS

CN 1427500 A 7/2003
CN 101053114 A 10/2007
(Continued)

OTHER PUBLICATIONS

International Search Report for PCT/EP2016/060413, dated Jul. 29, 2016, 5 pages.
(Continued)

*Primary Examiner* — Rakesh B Patel
(74) *Attorney, Agent, or Firm* — Nixon & Vanderhye P.C.

(57) ABSTRACT

A high-frequency conductor system has a high-frequency housing which comprises a housing base, a housing cover which is at a distance from the housing base, and a housing wall which runs circumferentially between the housing base and the housing cover, as a result of which an accommodation space is formed. At least one cable-bound RF bushing is arranged within the accommodation space. The cable-bound RF bushing is electrically isolated from the high-frequency housing. A capacitive coupling element is arranged on at least one part of the circumference of the cable-bound RF bushing and is electrically connected to said cable-bound RF bushing. The capacitive coupling element has two end sides which are oriented transverse or perpendicular to the propagation direction of the cable-bound RF bushing. A first coupling web is electrically connected to the high-frequency housing and is arranged at a distance from the end side in order to generate a capacitive coupling.

20 Claims, 6 Drawing Sheets

(51) Int. Cl.
*H01R 13/02* (2006.01)
*H01R 24/40* (2011.01)

(58) Field of Classification Search
USPC ..... 333/206, 207, 185
See application file for complete search history.

(56) References Cited

U.S. PATENT DOCUMENTS

| | | | |
|---|---|---|---|
| 2003/0184407 | A1 | 10/2003 | Tsunoda et al. |
| 2014/0055215 | A1 | 2/2014 | Rogers et al. |

FOREIGN PATENT DOCUMENTS

| | | | |
|---|---|---|---|
| CN | 101378142 | A | 3/2009 |
| CN | 102473992 | A | 5/2012 |
| CN | 202217757 | U | 5/2012 |
| CN | 102610878 | A | 7/2012 |
| DE | 1264636 | | 3/1968 |
| DE | 10 2009 031 373 | | 1/2011 |
| EP | 1 562 253 | | 10/2005 |
| GB | 1042277 | A | 9/1966 |
| GB | 1046277 | | 10/1966 |
| KR | 100 928 915 | | 11/2009 |
| WO | WO 2009/082117 | | 7/2009 |

OTHER PUBLICATIONS

Written Opinion of the ISA for PCT/EP2016/060413, dated Jul. 29, 2016, 8 pages (non-english).

English translation of the International Preliminary Report on Patentability and Written Opinion of the International Searching Authority dated Dec. 7, 2017, issued in International Application No. PCT/EP2016/060413.

English translation of Search Report dated Apr. 16, 2019, issued in related Chinese Patent Application No. 201680039433.5, 1 page.

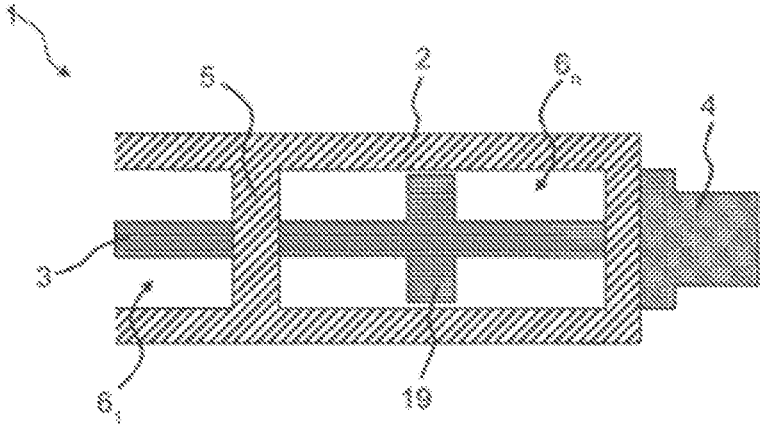
Fig. 9 (S.d.T.)

HIGH-FREQUENCY CONDUCTOR SYSTEM WITH CABLE-BOUND RF BUSHING

This application is the U.S. national phase of International Application No. PCT/EP2016/060413 filed 10 May 2016, which designated the U.S. and claims priority to DE Patent Application No. 10 2015 006 739.7 filed 22 May 2015, the entire contents of each of which are hereby incorporated by reference.

The invention relates to a high-frequency conductor system with a cable-bound RF bushing, in particular in the form of an RF filter. A high-frequency conductor system of this type is used for example in communications systems, in particular in the field of mobile communications. A shared antenna is often used for the transmitted and received signals in this context. In this case, the transmitted and received signals each use different frequency ranges, and the antenna has to be suitable for transmitting and receiving in both frequency ranges. To separate the transmitted and received signals, suitable frequency filtering is therefore required, by means of which the transmitted signals are passed from the transmitter to the antenna and the received signals are passed from the antenna to the receiver. Nowadays, radiofrequency filters of a cavity construction and/or coaxial construction are used for splitting the transmitted and received signals.

For example, a pair of radiofrequency filters may be used which both allow a particular frequency band to pass through (band-pass filters). Alternatively, a pair of radiofrequency filters may be used which both stop a particular frequency band (band-stop filters). Further, a pair of radiofrequency filters may be used of which one filter allows frequencies below a frequency between the transmitting and receiving band to pass through and stops frequencies above this frequency (low-pass filter) and the other filter stops frequencies below a frequency between the transmitting and receiving band and allows frequencies above it to pass through (high-pass filter). Further combinations of these filter types are also conceivable.

Filters of this type are often of a coaxial construction, since they consist of milled or cast parts, making them simple to manufacture.

U.S. 2014/0055215 A1 discloses a radiofrequency filter which comprises a conductor path arranged spaced apart on a metal layer. The conductor path comprises portions having a widened diameter (stub) which extend outwards perpendicular to the progression of the conductor path on one or both sides. A housing comprising a housing wall and a housing cover covers the conductor path and is adapted in shape to the progression of the conductor path.

WO 2009/082117 A1 discloses a radiofrequency filter in stripline technology, the internal conductor comprising a plurality of stubs. The housing shape follows the progression of the stubs of the internal conductor.

DE 10 2009 031 373 A1 discloses a radiofrequency filter comprising an external conductor and an internal conductor. The internal conductor consists of a plurality of internal conductor portions which are capacitively intercoupled to form a gap between them.

EP 1 562 253 A1 discloses a radiofrequency filter in which the resonant frequency can be varied during operation.

In the prior art, which is shown by way of example in FIG. 9, a high-frequency conductor system comprising a plurality of chambers is known, and can be used for example for filtering RF signals. The high-frequency conductor system 1 is shown with an open cover in a plan view. It comprises a high-frequency housing 2, an RF bushing 3 in the form of an internal conductor, and a connector 4 in the form of a coaxial plug. The RF bushing 3 is passed through transverse connections 5, which subdivide the high-frequency conductor system 1 into various chambers $\mathbf{6}_1$ to $\mathbf{6}_n$ and support it. These transverse connections 5 comprise an accommodation opening in the axial direction. The high-frequency housing 2 is preferably milled out of a workpiece, the transverse connections 5 being left behind. Part of the RF bushing 3 comprises regions 19 for capacitive coupling to the high-frequency housing 2. These regions 19 are formed by a widening of the RF bushing 3. These regions 19 have a round cross section in a plan view parallel to the progression of the RF bushing. The capacitive coupling takes place on the peripheral side face of these regions 19 towards the high-frequency housing 2.

A drawback of the prior art of FIG. 9 is that the capacitive coupling is not precisely reproducible.

Therefore, the object of the present invention is to provide a high-frequency conductor system with a cable-bound RF bushing, which has reproducible properties, is simple to manufacture, and keeps the level of occurring intermodulation products as low as possible.

The object is achieved by the present invention in accordance with independent claim 1. Advantageous embodiments are set out in the dependent claims.

The high-frequency conductor system according to the invention comprises a high-frequency housing which comprises a housing base, a housing cover which is at a distance from the housing base, and a housing wall which extends peripherally between the housing base and the housing cover, as a result of which an accommodation space is formed. At least one cable-bound RF bushing is arranged within the accommodation space. This is galvanically separated from the high-frequency housing. At least one capacitive coupling element is arranged on at least part of the periphery of the cable-bound RF bushing and is galvanically connected to the cable-bound RF bushing. The at least one capacitive coupling element has two opposing end faces which are oriented transverse or perpendicular to the propagation direction of the cable-bound RF bushing. At least one first coupling web is galvanically connected to the high-frequency housing and projects into the accommodation space at least in part. The at least one first coupling web is arranged at a distance from at least one first part of at least one of the two the end faces of the capacitive coupling element in order to generate a capacitive coupling.

It is particularly advantageous in the context of the invention that the coupling takes place via the end faces, since these are planar, in other words each end face lies entirely in a plane and is not spherically curved. An end face of this type can be reproduced much more precisely than if it were made cylindrical like the peripheral side face. At the same time, the entire cable-bound RF bushing can further be manufactured in a turning process. By means of the capacitive coupling element and the coupling web corresponding thereto, it is possible to achieve a filter effect within the high-frequency conductor system for high-frequency signals which are transmitted via the cable-bound RF bushing.

In this context, it is advantageous if more than 50%, preferably more than 60%, more preferably more than 70%, more preferably more than 80%, more preferably more than 90%, more preferably more than 95% of the total capacitive coupling between the capacitive coupling element and the high-frequency housing takes place via one or both end faces and the at least one coupling web.

The high-frequency conductor system additionally comprises at least one connector, in particular in the form of a coaxial plug, which makes electrical contacting of the cable-bound RF bushing possible from outside the high-frequency housing. This means that for example a coaxial cable can be connected to the high-frequency conductor system from the outside. In this context, the cable-bound RF bushing is preferably solely supported by the at least one connector and held in position within the accommodation space at a distance from the high-frequency housing. As a result, further holding means can be dispensed with, meaning that manufacture can be kept simple.

As an alternative or in addition to the mounting on the connector, the high-frequency conductor system may provide at least one holding and positioning web, which projects at least in part into the accommodation space and is passed through by an accommodation opening over the entire thickness thereof in the propagation direction, in other words in the extension direction of the cable-bound RF bushing. The accommodation opening is further accessible at least in a lateral direction transverse to the propagation direction over the entire thickness of the holding and positioning web. The holding and positioning web is therefore open to the accommodation opening from the outside transverse to the propagation direction over the entire thickness thereof. The cable-bound RF bushing is mounted within the accommodation opening on the at least one holding and positioning web. In this context, it is particularly advantageous that the cable-bound RF bushing can be inserted into the high-frequency housing of the high-frequency conductor system in a very simple manner. This facilitates in particular the insertion of the cable-bound RF bushing into a high-frequency conductor system in which the cable-bound RF bushing is also intended to have curves or kinks.

Preferably, an insulating medium is also arranged between the cable-bound RF bushing and the at least one holding and positioning web, meaning that the holding and positioning web and the cable-bound RF bushing are galvanically separated from one another. The insulating medium is preferably an insulating sleeve, which radially encloses the cable-bound RF bushing at least in part at the region at which the cable-bound RF bushing is mounted on or touches the holding and positioning web. The insulating sleeve preferably has an accommodation slit over the entire length thereof, into which the cable-bound RF bushing is inserted. This accommodation slit is preferably also accessible transverse to the length over the entire length. This makes it possible for the insulating sleeve to be connectable to the cable-bound RF bushing in a very simple manner. The insulating sleeve can therefore be placed laterally on the cable-bound RF bushing.

For improved fastening, the insulating sleeve comprises, on at least part of the periphery thereof, at least one coding projection and/or at least one coding opening, which engages with at least one coding opening and/or at least one coding projection on the holding and positioning web. As a result, a precise fit of the insulating sleeve on the holding and positioning web is provided, meaning that the mounting of the cable-bound RF bushing on the holding and positioning web and thus within the accommodation space is improved.

Preferably, a positioning element protruding beyond the cross section of the cable-bound RF bushing is also arranged on the cable-bound RF bushing, meaning that the insulating sleeve is positioned on the positioning element so as to be undisplaceable or only displaceable to a limited extent in the propagation direction of the RF bushing. Naturally, it is also possible for two positioning elements protruding beyond the cross section of the cable-bound RF bushing to be arranged thereon, in which case the insulating sleeve is arranged between these two positioning elements so as to be undisplaceable or only displaceable to a limited extent in the propagation direction. The at least one or the two positioning elements act as a stop limit in this case, meaning that the insulating sleeve which is positioned on the periphery of the RF bushing or through which the RF bushing extends cannot be displaced freely on the RF bushing in the propagation direction, in other words in the extension direction thereof. The positioning element preferably extends only over part of the length of the RF bushing in the propagation direction, and preferably has a shorter length than the insulating sleeve, which likewise extends only over part of the length of the RF bushing.

Preferably, the positioning element is formed integrally with the cable-bound RF bushing and is a part thereof. In this case, the at least one positioning element may have the form of a positioning tab, and thus extend only over part of the periphery of the cable-bound RF bushing in the direction of the high-frequency housing, or else it may extend outwards, in other words in the direction of the high-frequency housing, over the entire periphery, preferably uniformly. In the simplest case, the positioning element may be melted and resolidified solder, by means of which a stop limit for the insulating sleeve is provided at a particular point on the RF bushing.

Preferably, in relation to a capacitive coupling element, a second coupling web is further arranged spaced apart from the first coupling web in the propagation direction of the cable-bound RF bushing, a first coupling chamber being formed between the two coupling webs. In this case, the first part of a capacitive coupling element is arranged in this first coupling chamber or the first part of the capacitive coupling element projects into this first coupling chamber. In relation to a capacitive coupling element, as well as the second coupling web, a third and at least a fourth coupling web may also further be formed, which likewise project into the accommodation space and a) are arranged on a housing wall opposite the first housing wall on which the first coupling chamber and the first and second coupling webs are arranged, and/or
b) are arranged on the housing base or on the housing cover.

This means that for example a third coupling web is arranged on the longitudinal wall of the accommodation space opposite the first coupling web. By contrast, the fourth coupling web is arranged on the longitudinal wall of the accommodation space opposite the second coupling web. A coupling chamber, in this case a second coupling chamber, is likewise formed between the third and fourth coupling webs. At least a second part of the capacitive coupling element projects into this second coupling chamber. By using a plurality of coupling webs and by varying the distance between each coupling web and the capacitive coupling element, the strength of the capacitive coupling can be changed. If the at least one first coupling web overlaps an end face of the capacitive coupling element over a larger area, an increase in the coupling capacity is achieved by comparison with if the area were smaller. The same applies if the distance between the coupling web and the capacitive coupling element is reduced. It is also possible for a potting compound, for example, to be used instead of air as the dielectric between the at least one first coupling web and the capacitive coupling element.

The at least one first coupling web, and preferably also all further coupling webs, are formed integrally with the housing base and/or the housing wall and are a part thereof. This means that the first coupling web and the third coupling web need not for example be located diametrically opposite, preferably on the two opposing housing walls, but instead the third coupling web may also for example be arranged in the housing base. It is also possible for one of these coupling webs to be fixed to the housing cover, in which case it is preferably fixed by means of a screw connection.

In this context, the housing base and/or the housing wall comprises at least one recess. In this case, the at least one recess is formed in the region of a peripheral side face of the at least one capacitive coupling element, meaning that a capacitive coupling between the peripheral side face of the at least one capacitive coupling element and the high-frequency housing is reduced. This is attributable in particular to the fact that the capacitive coupling element is preferably manufactured together with the RF bushing as a turned part, the tolerances for manufacturing round bodies being strictly greater than for manufacturing planar faces. These recesses therefore ensure that the capacitive coupling takes place predominantly only via faces which are more mechanically precisely reproducible, such as the planar end faces.

In addition, it is possible for the high-frequency housing to have at least one opening through which a tuning element can be or is inserted. In this case, the at least one tuning element is arranged radially with respect to a peripheral side face of the at least one capacitive coupling element. However, the at least one tuning element may also meet a side face of the capacitive coupling element at a different angle and even touch it. The at least one tuning element is preferably made of a dielectric material, it being possible to change the resonant frequencies of the radiofrequency filter by introducing or screwing the tuning element different distances into the accommodation space. The at least one tuning element may also be made of a metal or be provided at least in part with an electrically conductive coating.

The at least one capacitive coupling element and/or the at least one insulating sleeve and/or the at least one positioning element are connected centrally or eccentrically to the cable-bound RF bushing. The cross-sectional shape of the at least one insulating sleeve and/or of the at least one capacitive coupling element and/or of the at least one positioning element may be selected differently, and for example correspond to or approximate to a square, rectangle, oval, circle, or regular or irregular n-gon in a plan view.

For better insertion of the RF bushing, the accommodation opening preferably widens conically within the holding and positioning web in the direction transverse to the propagation direction over the entire thickness in the direction of the high-frequency housing. If the accommodation opening is open for example in the direction of the housing cover, when the housing cover is removed the cable-bound RF bushing can be introduced into the holding and positioning web in a very simple manner. The holding and positioning web is preferably formed integrally on the housing wall and/or on the housing base. It would also be possible for the holding and positioning web to be formed on the housing cover or screwed to the housing cover. In this case, the cable-bound RF bushing is inserted into the holding and positioning web, before the two are inserted into the open high-frequency housing. In this context, it should be noted that it is advantageous if the holding and positioning web projects sufficiently far into the accommodation space that the cable-bound RF bushing is mounted centred in the accommodation space, in other words the minimum distance from the electrically conductive high-frequency housing is substantially identical.

Various embodiments of the invention are described in the following by way of example with reference to the drawings. Like subjects have like reference numerals. In detail, in the corresponding drawings:

FIG. 9 is a simplified plan view of a high-frequency conductor system comprising a plurality of chambers which is standard disclosed technology (s.d.t.) known in the art.

Figure 1:
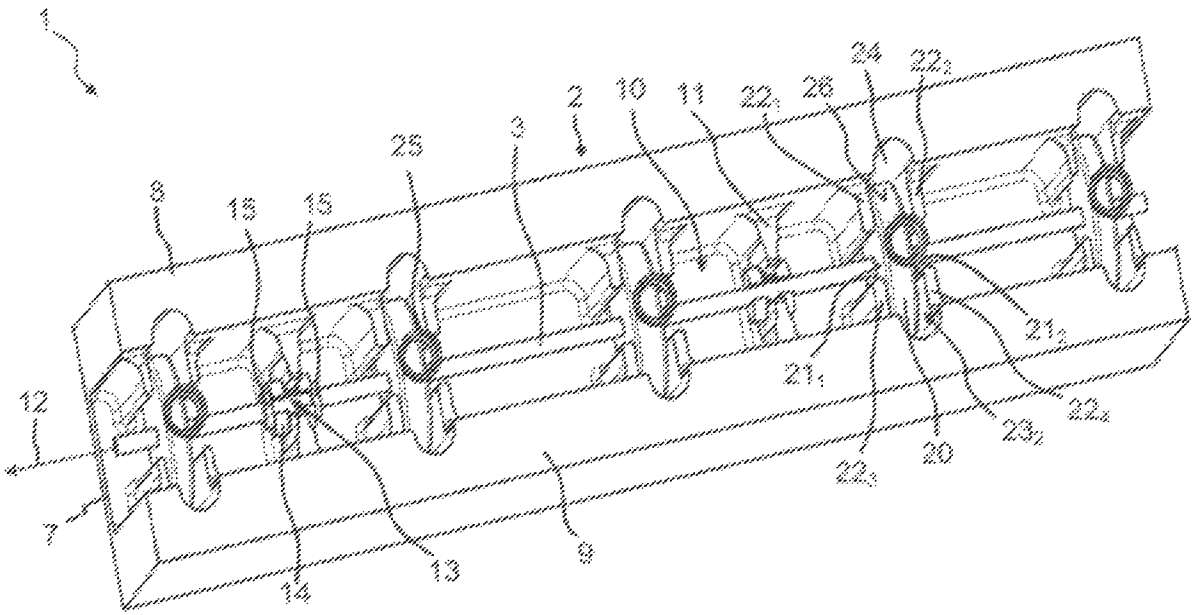
FIG. 1 is a three-dimensional drawing of the high-frequency conductor system according to the invention with the housing cover open.
Figure 7:
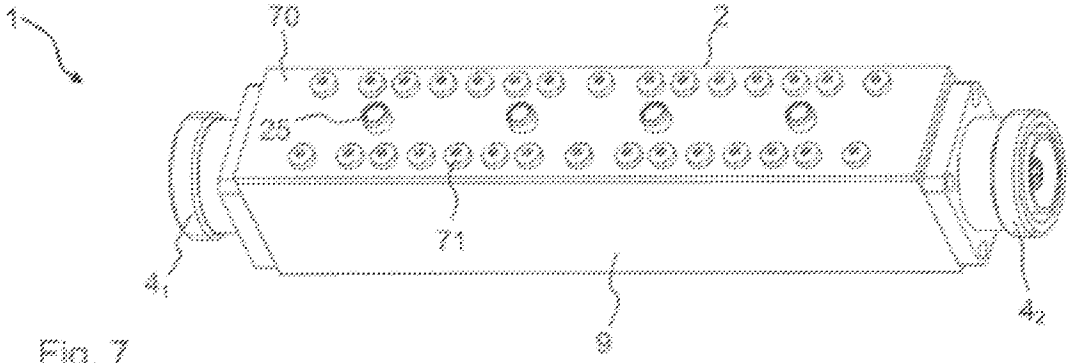
FIG. 7 is a three-dimensional view of the high-frequency conductor system according to the invention with a closed housing cover, comprising two connectors.

FIG. 1 is a three-dimensional drawing of the high-frequency conductor system 1 according to the invention with an open housing cover 70, which is shown in FIG. 7. The high-frequency conductor system 1 comprises a high-frequency housing 2, which comprises a housing base 7, a housing cover at a distance from the housing base 7, and a housing wall 8, 9 which extends peripherally between the housing base 7 and the housing cover 70, as a result of which an accommodation space 10 is formed. A cable-bound RF bushing 3 is arranged within the accommodation space 10 of the high-frequency housing 2. The cable-bound RF bushing 3 is galvanically separated from the high-frequency housing 2.

In the prior art according to FIG. 9, the RF bushing 3 is passed through openings in the transverse connections 5 and mounted galvanically separated therein, these openings being created by a drill or mill introduced into the connector 4, the drill having at the tip a slight play or oscillation which results in the transverse connections 5 at the greatest distance from the accommodation opening no longer being drilled through in a clean and centred manner. Galvanisation additionally takes place non-uniformly, and the layer thickness cannot be set exactly. Deburring to reduce surface roughness is also only possible with difficulty. As a result, the filter properties are worsened, and sufficiently high reproducibility of the electrical properties is no longer provided during manufacture. This means that because of the different mounting of the RF bushing 3 the distance of the regions 19 from the high-frequency housing 2 is different, meaning that the capacitive coupling turns out differently and the filter properties are thus changed.

For this purpose, the high-frequency conductor system 1 further comprises at least one holding and positioning web 11, which projects at least in part into the accommodation space 10 and is passed through over the entire thickness thereof in the propagation direction 12 of the cable-bound RF bushing 3 by an accommodation opening 13. The accommodation opening 13 through which the RF bushing 3 extends is further accessible over the entire thickness, in other words over the entire width of the holding and positioning web 11, at least in a lateral direction transverse to the propagation direction 12.

The cable-bound RF bushing 3 is mounted on the at least one holding and positioning web 11 within the accommodation opening 13. In this embodiment, when the housing cover 70 is open, the cable-bound RF bushing 3 can be inserted from above in the direction of the housing base 7, being kept at a distance from the housing base 7 and from both housing walls 8, 9 by the holding and positioning web 11. The holding and positioning web 11 is preferably formed integrally on the housing wall 8, 9 and/or on the housing base 7. However, the holding and positioning web 11 may also consist of a separate element, which can preferably be fixed to the housing wall 8, 9 and/or to the housing base 7 or even to the housing cover 70 by means of a screw connection. In this case, the holding and positioning web 11 may for example consist of plastics material or comprise a plastics material core which is coated with a preferably electrically conductive medium.

The holding and positioning web 11 projects sufficiently far into the accommodation space 10 that the cable-bound RF bushing 3 is arranged centred within the accommodation space 10. This means that it has approximately the same minimum distance from the housing walls 8, 9, the housing base 7 and the housing cover 70. However, the distance from the housing walls 8, 9, the housing base 7 and the housing cover 70 can be freely determined and may be different depending on the application.

Preferably, a further insulating medium 14 is arranged between the cable-bound RF bushing 3 and the at least one holding and positioning web 11, meaning that the holding and positioning web 11 and the cable-bound RF bushing 3 are galvanically separated from one another. If the holding and positioning web 11 consists of a dielectric, a separate insulating medium 14 can be dispensed with.

The insulating medium 14 may be in the form of a dielectric layer on at least part of the holding and positioning web 11, the cable-bound RF bushing 3 being mounted on this part. Alternatively or additionally, it is also possible for the insulating medium 14 to be in the form of a dielectric layer on at least the part of the cable-bound RF bushing 3 which is mounted on the holding and positioning web 11. A dielectric layer of this type could for example consist of a shrink-on tube which is applied to the RF bushing 3.

Preferably, however, the insulating medium 14 is formed as an insulating sleeve 14, as is also shown in FIG. 1. The insulating sleeve 14 radially encloses the cable-bound RF bushing 3 in part in the region in which the cable-bound RF bushing 3 is mounted on the holding and positioning web 11.

In the embodiment of FIG. 1, the insulating sleeve 14 is in the form of a dumbbell, the mounting on the holding and positioning web 11 taking place in the region of reduced diameter. This region comprises peripheral side faces which extend parallel to the propagation direction 12 of the cable-bound RF bushing 3, the peripheral side faces of the insulating sleeve 14 being engaged with the holding and positioning web 11.

In this context, preferably more than 30%, more preferably more than 40%, more preferably more than 50% of the peripheral side faces of the insulating sleeve 14 are engaged with the holding and positioning web 11.

Preferably, at least one positioning element 15 is further additionally arranged on the cable-bound RF bushing 3. The at least one positioning element 15 preferably protrudes beyond the cross section of the cable-bound RF bushing 3. The diameter of the cable-bound RF bushing 3 therefore increases in the region in which the at least one positioning element 15 is arranged. Preferably, the at least one positioning element 15 is formed integrally with the cable-bound RF bushing 3 or is a part thereof. The cable-bound RF bushing 3 is preferably manufactured as a turned part. This means that the at least one positioning element 15 is already arranged on the cable-bound RF bushing 3 when the cable-bound RF bushing 3 is connected, preferably clamped, to the insulating sleeve 14. The at least one positioning element 15 results in a simplified mounting process, because it is visually clear where the insulating sleeve 14 is to be mounted. In addition, it is also ensured that the insulating sleeve 14 cannot be displaced in or counter to the propagation direction 12, in other words in the extension direction of the cable-bound RF bushing 3. The at least one positioning element 15 therefore acts as a stop limit.

So as to prevent displacement of the insulating sleeve 14 in both propagation directions of the RF bushing 3 and further to simplify the mounting, two positioning elements 15 are preferably attached to the points on the RF bushing 3 between which the insulating sleeve 14 is inserted in the subsequent mounting process. The two positioning elements 15 are spaced sufficiently far apart in the propagation direction 12, in other words in the extension direction of the RF bushing 3, that the insulating sleeve 14 is placed on adjacent thereto, and preferably that each end face of the insulating sleeve is positioned against one positioning element 15.

The high-frequency conductor system 1 comprises at least one capacitive coupling element 20, which is arranged on at least part of the periphery of the cable-bound RF bushing 3. The at least one capacitive coupling element 20 is galvanically connected to the cable-bound RF bushing 3. The at least one capacitive coupling element 20 comprises two end faces $21_1$, $21_2$, which are oriented transverse or perpendicular to the propagation direction 12, in other words to the extension direction of the cable-bound RF bushing 3, in other words extend transverse or perpendicular thereto.

For cooperation with this at least one capacitive coupling element 20, the high-frequency conductor system 1 further provides at least one first coupling web $22_1$, which is galvanically connected to the high-frequency housing 2. This at least one first coupling web $22_1$ projects at least in part into the accommodation space 10. The at least one first coupling web $22_1$ is arranged at a distance from at least a first part of an end face $21_1$ of the capacitive coupling element 20. In this context, the aim of the invention is that the capacitive coupling between the capacitive coupling element 20 and the high-frequency housing 2 takes place predominantly via the end faces $21_1$, $21_2$ of the capacitive coupling element 20. These end faces $21_1$, $21_2$ can preferably be manufactured planar, in other words flat, thus only having a component extending perpendicular to the propagation direction 12. Capacitive couplings at rounded points are more difficult to reproduce, even if these rounded points are manufactured in a turning process.

FIG. 1 further shows a second, a third and a fourth coupling web $22_2$, $22_3$, $22_4$, via which capacitive coupling between the first and/or second end faces $21_1$, $21_2$ and the high-frequency housing 2 likewise takes place.

The second coupling web $22_2$ is arranged at a distance from the first coupling web $22_1$ in the propagation direction 12. A first coupling chamber $23_1$ is formed between the two coupling webs $22_1$, $22_2$. A first part of the capacitive coupling element 20 projects into this first coupling chamber $23_1$.

The statements made for the first and second coupling webs $22_1$, $22_2$ also apply to the third and fourth coupling webs $22_3$, $22_4$.

So as to be able to reduce capacitive coupling of a peripheral side face 26 to the high-frequency housing 2 insofar as possible, at least one recess 24 is formed in the housing base 7 and/or in one or both of the housing walls 8, 9. This increases the space filled with a dielectric, preferably with air, between the peripheral side face 26 of the capacitive coupling element 20 and the high-frequency housing 2, reducing the capacitive coupling via the peripheral side face 26.

Preferably, the at least one first coupling web $22_1$ and also the further coupling webs $22_2$, $22_3$, $22_4$ are formed integrally with the housing base 7 and/or with the housing wall 8, 9 and/or are part thereof.

Preferably, the high-frequency conductor system 1 is made of aluminium. The accommodation space 10 is preferably created by a milling process, the coupling webs $22_1$, $22_2$, $22_3$, $22_4$ and/or the holding and positioning web 11 being left behind in this case.

It is also possible for the coupling webs $22_1$, $22_2$, $22_3$, $22_4$ to be manufactured separately and for example to be rigidly connected to the high-frequency housing 2 via a screw connection. The coupling webs $22_1$, $22_2$, $22_3$, $22_4$ preferably consist of a metal, but may also consist of a dielectric which has been coated at least in part with an electrically conductive layer.

The coupling webs $22_1$, $22_2$, $22_3$, $22_4$ may be of a height which extends from the housing base 7 to the housing cover 70. The height therefore corresponds to the height of the housing walls 8, 9.

Figure 6:
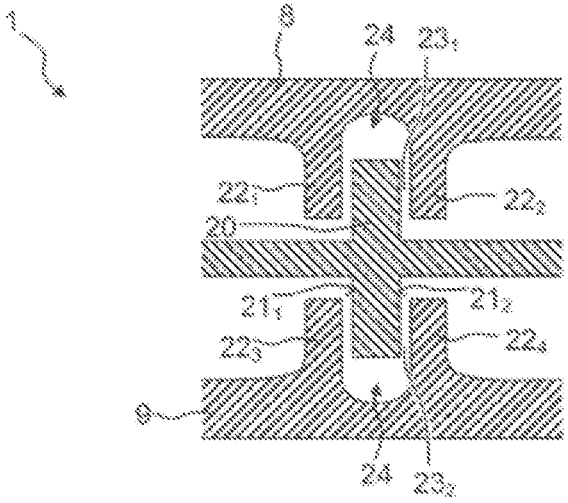
FIG. 6 is a simplified plan view of the capacitive coupling element and four coupling webs of the high-frequency conductor system according to the invention.

Because the coupling webs $22_1$, $22_2$, $22_3$, $22_4$ are required for manufacturing a capacitive coupling which has to have a value which can be precisely calculated in advance, the coupling webs $22_1$, $22_2$, $22_3$, $22_4$ may differ from one another in whole or in part both in height and in width. Referring to FIG. 6, the capacitive coupling between the cable-bound RF bushing 3 and the high-frequency housing 2 is described in greater detail in the following.

FIG. 1 also shows additional further capacitive coupling elements 20, which are arranged spaced apart axially on the cable-bound RF bushing 3. The further capacitive coupling elements 20 may differ from one another in whole or in part in dimensions. Each of these further capacitive coupling elements 20 comprises one or more coupling webs $22_1$, $22_2$, $22_3$, $22_4$, arranged as described above.

FIG. 1 also further shows that the high-frequency housing 2 comprises at least one opening 25. This at least one opening 25 may, as shown in FIG. 1, be formed on the housing cover 70. However, this at least one opening 25 may also be formed on the housing walls 8, 9 or on the housing base 7. As a result of the at least one opening 25, a tuning element (not shown) can be or is introduced into the accommodation space 10. The at least one tuning element is arranged radially with respect to a peripheral side face 26 of the at least one capacitive coupling element 20. However, the at least one tuning element may meet or point towards the peripheral side face 26 at a different angle. The at least one tuning element may preferably be introduced deeper or less deep into the accommodation space 10 by way of a screw connection. As a result, the resonant frequency of the radiofrequency filter formed within the high-frequency conductor system 1 can be precisely readjusted. In this context, it is also possible for the tuning element to touch or even dip into the capacitive coupling element 20. This is the case in particular if the tuning element consists of a dielectric.

Figure 2:
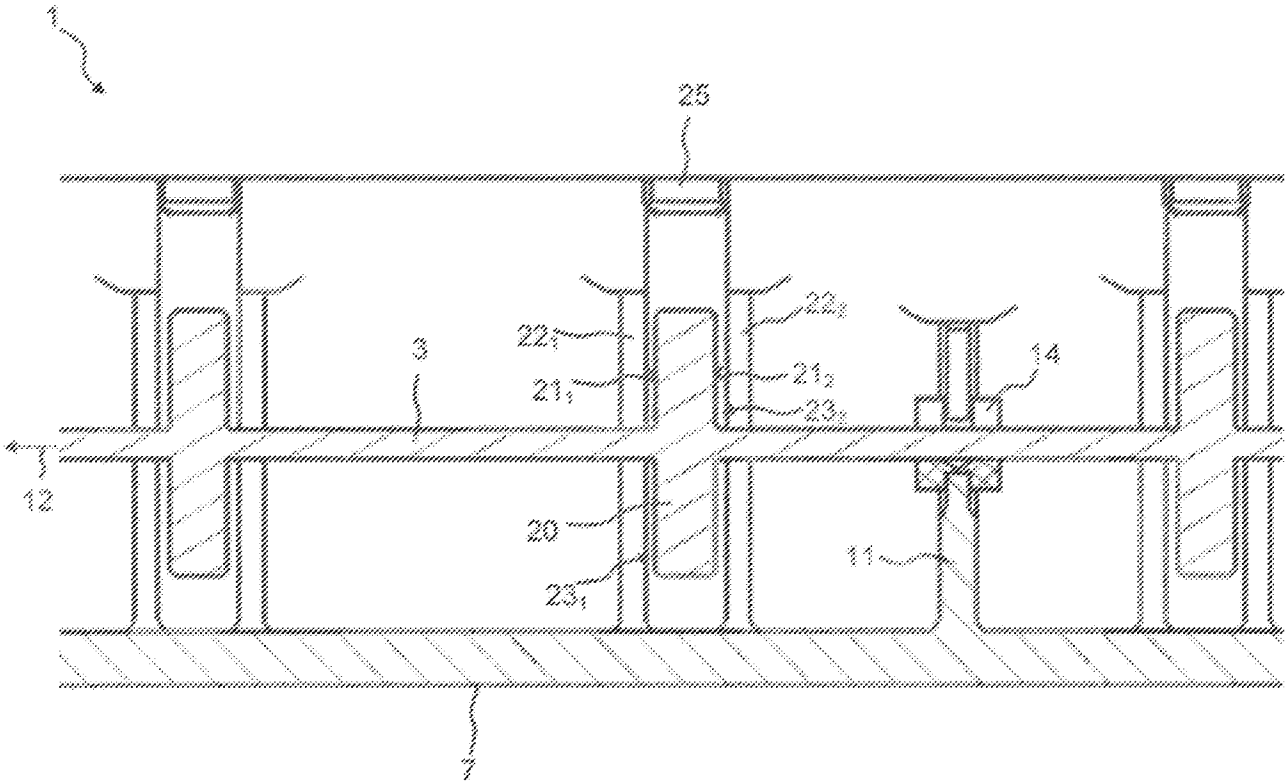
FIG. 2 is a longitudinal section through the high-frequency conductor system according to the invention along the propagation direction of the cable-bound RF bushing.

FIG. 2 is a longitudinal section through the high-frequency conductor system 1 along the propagation direction 12 of the wire-connected RF bushing 3.

The insulating sleeve 14 is in the form of a dumbbell. The at least one holding and positioning web 11 comprises the accommodation opening 13 which passes through it completely in the propagation direction 12. This accommodation opening 13 is further accessible over the entire thickness of the holding and positioning web 11 at least in a lateral direction transverse to the propagation direction 12. This means that the holding and positioning web 11 extends further than the insulating sleeve 14 held thereby in the direction of the housing cover. The holding and positioning web 11 therefore has for example a U-shaped form or a peak-trough-peak form, the insulating sleeve 14 being arranged in the trough or closer to in the trough than to on the peak.

The insulating sleeve 14, shown here in a longitudinal section, in other words in the propagation direction 12, has regions of increased diameter and regions of reduced diameter. The holding and positioning element 11 engages in the region of reduced diameter. However, the insulating sleeve 11 could also being configured precisely the other way around, in such a way that the region of increased diameter engages in a recess in the holding and positioning web 11.

Further, the integral formation of the capacitive coupling element 20 together with the cable-bound RF bushing 3 is also shown. The capacitive coupling element 20 is arranged at a distance from the housing base 7. The propagation of the capacitive coupling element 20 in the direction of the housing base 7 is preferably of a length shorter than the total of the length of the holding and positioning web 11 plus the radius of the insulating sleeve 14.

The opening 25 for receiving the tuning element passes preferably perpendicularly through the housing cover 70, in such a way that the tuning element can be or is introduced into the accommodation space 10 perpendicular to the propagation direction 12.

Figure 3:
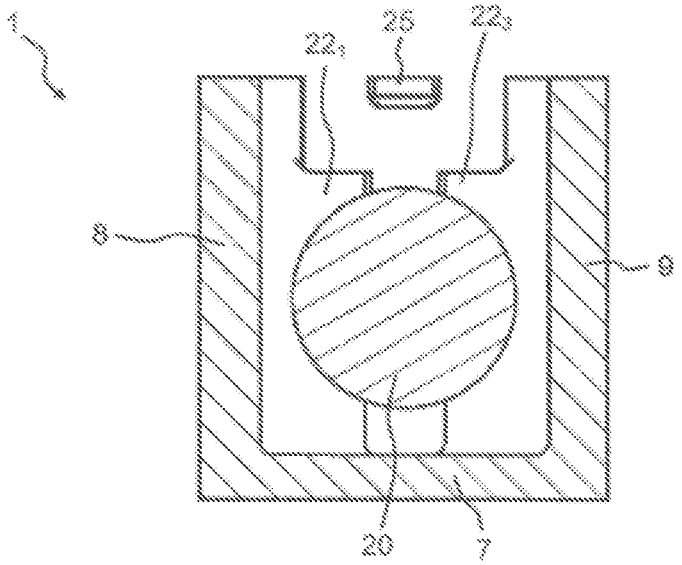
FIG. 3 is a cross section through a capacitive coupling element of the high-frequency conductor system according to the invention.

FIG. 3 is a cross section through the capacitive coupling element 20 of the high-frequency conductor system 1 according to the invention. The capacitive coupling element 20 has a round cross section. However, other cross sections are also conceivable. It is at a distance from the housing walls 8, 9 and from the housing base 7. The first and third coupling webs $22_1$, $22_3$ can also be seen in the background. The opening 25 for receiving the tuning element passes through a housing cover 70 (not shown in this drawing) perpendicular to the propagation direction 12 of the cable-bound RF bushing 3.

Figure 4:
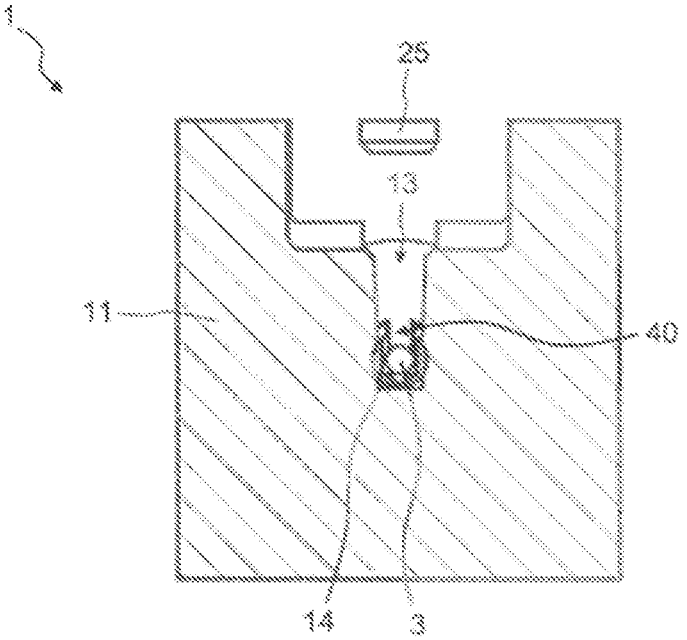
FIG. 4 is a cross section through the insulating sleeve, the cable-bound RF bushing, and the holding and positioning web of the high-frequency conductor system according to the invention.

FIG. 4 is a cross section through the insulating sleeve 14 and the holding and positioning web 11 of the high-frequency conductor system 1 according to the invention. The insulating sleeve 14 has an accommodation slit 40 over the entire length thereof, into which the cable-bound RF bushing 3 is inserted. As is shown in FIG. 4, this accommodation slit 40 is accessible over the entire length of the insulating sleeve 14 in a lateral direction transverse to the propagation direction 12.

The accommodation opening 13 of the holding and positioning web 11 increases in cross section in the direction of the high-frequency housing 2. This increase is preferably conical or parabolic. By way of this accommodation opening 13, which is accessible over the entire thickness of the holding and positioning web 11 in the lateral direction transverse to the propagation direction 12, the insulating sleeve 14 can be inserted together with the cable-bound RF bushing 3.

Figure 5:
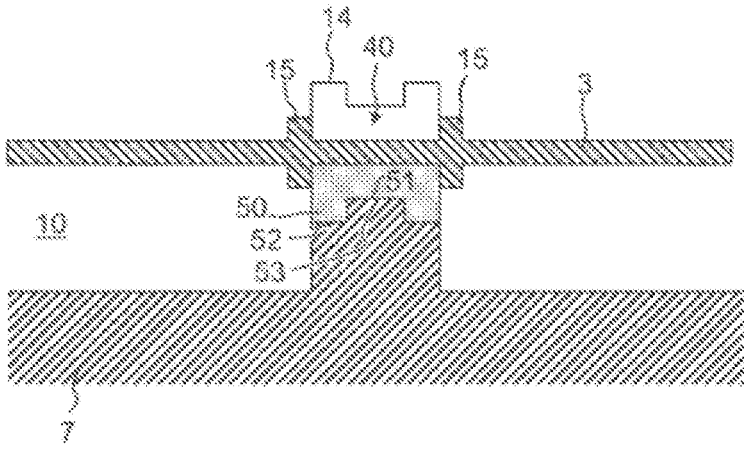
FIG. 5 is a longitudinal section through the insulating sleeve and through part of the cable-bound RF bushing and the holding and positioning web of the high-frequency conductor system according to the invention.

FIG. 5 is a longitudinal section through the insulating sleeve 14 and part of the cable-bound RF bushing 3 as well as through the holding and positioning web 11 of the high-frequency conductor system 1 according to the invention. By way of the accommodation slit 40, the cable-bound RF bushing 3 is inserted into the insulating sleeve 14. The accommodation slit 40 is preferably somewhat smaller than the diameter of the RF bushing 3, the insulating sleeve 14 preferably being formed resilient at least in part, resulting in a clamping connection between the insulating sleeve 14 and the cable-bound RF bushing 3.

Instead of an accommodation slit 40 which is accessible over the entire length of the insulating sleeve 14 in a lateral direction transverse to the propagation direction 12, the insulating sleeve 14 may also be constructed in such a way that it for example consists of two sleeve halves which are movably interconnected on one face and in which the cable-bound RF bushing 3 is arranged, the two sleeve halves being clamped, clipped, screwed or glued to one another on the other face thereof.

This insulating sleeve 14, which in this case too has the shape of a dumbbell in cross section, has regions of a larger diameter and regions of a smaller diameter. In general, it can be said that the insulating sleeve 14 has at least one coding projection 50 and/or at least one coding opening 51 at least on part of the periphery thereof, which engages with at least one coding opening 52 and/or at least one coding projection 53 on the holding and positioning web 11.

Considered in cross section, the insulating sleeve 14 is preferably engaged with the holding and positioning web 11 over a region greater than 90°, preferably greater than 120°, preferably greater than 150°, preferably greater than 180°.

The coding projection 50 and/or the coding opening 51 may be formed over the entire length of the insulating sleeve 14.

The positioning element 15, of which preferably two, spaced apart from one another, are formed on the cable-bound RF bushing in an integral formation therewith, acts as a stop limit for the insulating sleeve 14 in the propagation direction 12. The positioning element 15 has a smaller length and preferably a smaller diameter than the insulating sleeve 14. It is shown that the positioning element 15 extends over the entire periphery of the cable-bound RF bushing 3. However, it is also possible for the at least one positioning element 15 to be in the form of a positioning tab and thus only to extend over part of the periphery of the cable-bound RF bushing 3. However, this can no longer be manufactured solely by a milling process.

The insulating sleeve 14 preferably consists of plastics material or a rubber.

The insulating sleeve 14 and/or the at least one positioning element 15 are connected centrally or eccentrically to the cable-bound RF bushing 3.

FIG. 6 is a simplified plan view of the capacitive coupling element 20 and four coupling webs $\mathbf{22}_1$, $\mathbf{22}_2$, $\mathbf{22}_3$, $\mathbf{22}_4$ of the high-frequency conductor system 1 according to the invention. The coupling webs $\mathbf{22}_1$, $\mathbf{22}_2$, $\mathbf{22}_3$, $\mathbf{22}_4$ are formed integrally with the housing walls 8, 9 and the housing base 7. The capacitive coupling element 20 is galvanically separated from the coupling webs $\mathbf{22}_1$, $\mathbf{22}_2$, $\mathbf{22}_3$, $\mathbf{22}_4$. The first and second coupling webs $\mathbf{22}_1$, $\mathbf{22}_2$ are arranged mutually offset in the propagation direction 12 on the same housing wall 8. A first coupling chamber $\mathbf{23}_1$ is thus formed between the two coupling webs $\mathbf{22}_1$, $\mathbf{22}_2$. An additional recess 24 is formed in the region of a peripheral side face 26 of the at least one capacitive coupling element 20, reducing the capacitive coupling between the peripheral side face 26 of the at least one capacitive coupling element 20 and the high-frequency housing 2. The first coupling chamber $\mathbf{23}_1$ is enlarged as a result.

Like the first and second coupling webs $\mathbf{22}_1$, $\mathbf{22}_2$, the third and fourth coupling webs $\mathbf{22}_3$, $\mathbf{22}_4$ are arranged spaced apart on a housing wall 9. A second coupling chamber $\mathbf{22}_2$ is formed between the third and fourth coupling webs $\mathbf{22}_3$, $\mathbf{22}_4$. This second coupling chamber may be enlarged by a recess 24. The recess 24 may also extend into the housing base 7. By way of a recess 24 of this type in the housing base 7, the first coupling chamber $\mathbf{23}_1$ and the second coupling chamber $\mathbf{23}_2$ are also further interconnected. Just as the first coupling webs $\mathbf{22}_1$, $\mathbf{22}_2$ are arranged on the housing base 7 and/or on a housing wall 8, the third or fourth coupling webs $\mathbf{22}_3$, $\mathbf{22}_4$ are arranged symmetrically with respect thereto on the housing base 7 or a housing wall 9. Preferably, the third housing web $\mathbf{22}_3$ is arranged on a housing wall 8, 9 opposing the housing wall 8, 9 on which the first coupling web $\mathbf{22}_1$ of the first coupling chamber $\mathbf{23}_1$ is arranged. The same applies to the fourth coupling web $\mathbf{22}_4$ and the second coupling web $\mathbf{22}_2$. However, it is also possible for the third coupling web $\mathbf{22}_3$ to be arranged on the housing base 7 or on the housing cover 70 (not shown until FIG. 7) and to project into the accommodation space 10. In this case, the same would also apply to the fourth coupling web $\mathbf{22}_4$ with respect to the second coupling web $\mathbf{22}_2$. The thickness of the coupling webs $\mathbf{22}_1$, $\mathbf{22}_2$, $\mathbf{22}_3$, $\mathbf{22}_4$ among one another may also be selected as desired, as may the arrangement and the spacing on and from the housing base 7, the housing walls 8, 9 and the housing cover 70.

The RF bushing 3 may also have a kink or curve, causing the propagation direction 12 to change at this point.

FIG. 7 is a three-dimensional view of the high-frequency conductor system 1 according to the invention with a closed housing cover 70, the high-frequency conductor system 1 having two connectors $\mathbf{4}_1$, $\mathbf{4}_2$. The connectors $\mathbf{4}_1$, $\mathbf{4}_2$ are for connecting the high-frequency conductor system 1 to further components, such as an antenna unit. For this purpose, a cable, preferably a coaxial cable, may be connected to the connectors $\mathbf{4}_1$, $\mathbf{4}_2$. The housing cover 70 is connected to the housing walls 8, 9 by means of a multiplicity of screw connections 71. The high-frequency housing 2 is thus preferably sealed tightly against high frequencies. This means that no interference radiation can enter it, and likewise that no signals can escape from the high-frequency housing 2, except at the two connectors $\mathbf{4}_1$, $\mathbf{4}_2$.

Figure 8:
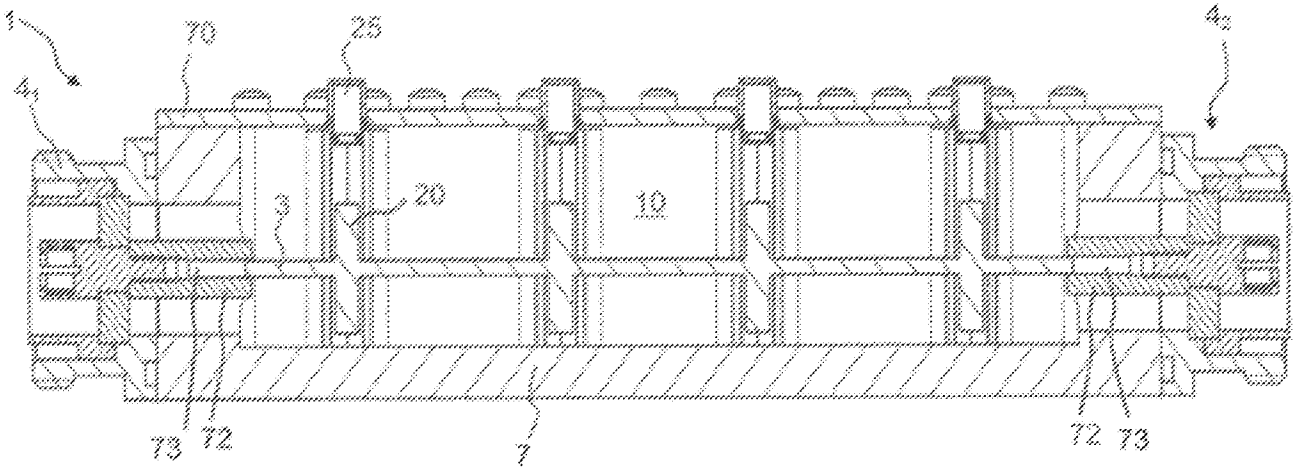
FIG. 8 is a longitudinal section through a further embodiment of the high-frequency conductor system according to the invention, in which the cable-bound RF bushing is held in the accommodation space solely by the connectors.

FIG. 8 is a longitudinal section through a further embodiment of the high-frequency conductor system 1, in which the cable-bound RF bushing 3 is held in the accommodation space 10 solely by the connectors $\mathbf{4}_1$, $\mathbf{4}_2$. The connectors $\mathbf{4}_1$, $\mathbf{4}_2$, which are preferably coaxial plugs, are for example screwed to the housing walls 8, 9 and/or to the housing base 7. The connectors $\mathbf{4}_1$, $\mathbf{4}_2$ have an HF internal conductor accommodation element for accommodating and contacting an internal conductor of the coaxial cable to be accommodated. This HF internal conductor accommodation element is electrically conductively connected to a holding element 72, which preferably has an accommodation hole 73 into which the cable-bound RF bushing 3 is inserted. At the ends thereof, the cable-bound RF bushing 3 is preferably fully radially enclosed by the sleeve-shaped or sleeve-springshaped holding element 72. This is preferably a non-positive and/or positive and/or material connection In addition, the RF bushing 3 is preferably further soldered to the connector $\mathbf{4}_1$, $\mathbf{4}_2$, or more precisely to the holding element 72.

The cable-bound RF bushing 3 is supported by the at least one connector $\mathbf{4}_1$, $\mathbf{4}_2$, and held in position at a distance from the high-frequency housing 2 within the accommodation space 10. The RF bushing 3 may be held solely by the at least one connector $\mathbf{4}_1$, $\mathbf{4}_2$, as shown in FIG. 8. However, the RF bushing 3 may also be held solely by the holding and positioning web 11, as was described in the preceding embodiments. Finally, it may also be held jointly, in other words by the at least one connector $\mathbf{4}_1$, $\mathbf{4}_2$ and by at least one holding and positioning web 11.

The invention claimed is:

1. A high-frequency conductor system with at least one cable-bound RF bushing, comprising:

a high-frequency housing which comprises a housing base, a housing cover which is at a distance from the housing base, and a housing wall which extends peripherally between the housing base and the housing cover to form an accommodation space;

the at least one cable-bound RF bushing being arranged within the accommodation space of the high-frequency housing;

the at least one cable-bound RF bushing being galvanically separated from the high-frequency housing;

at least one capacitive coupling element arranged on at least part of a periphery of the at least one cable-bound RF bushing, the at least one capacitive coupling element being galvanically connected to the at least one cable-bound RF bushing;

the at least one capacitive coupling element comprising two opposing end faces which are oriented transversely or perpendicularly to a propagation direction of the at least one cable-bound RF bushing;

at least one first coupling web galvanically connected to the high-frequency housing and projecting into the accommodation space at least in part;

the at least one first coupling web being arranged at a distance from at least one first part of at least one of the two opposing end faces of the at least one capacitive coupling element in order to generate a capacitive coupling between the at least one cable-bound RF bushing and the high-frequency housing via at least one of the two opposing end faces;

a second coupling web arranged spaced apart from the first coupling web in the propagation direction of the at least one cable-bound RF bushing, a first coupling chamber being formed between the first and second coupling webs;

at least a first part of the capacitive coupling element projecting into the first coupling chamber between the first and second coupling webs; and a third coupling web and a fourth coupling web, which project into the accommodation space and are arranged on a) a housing wall portion opposing a housing wall portion on which the first coupling chamber comprising the first and second coupling webs is arranged, and/or b) the housing base or the housing cover;

a second coupling chamber being formed between the third and fourth coupling webs;

at least a second part of the capacitive coupling element projecting into the second coupling chamber between the third and the fourth coupling webs.

2. The high-frequency conductor system according to claim 1, wherein:

the high-frequency housing defines at least one opening;

a tuning element is insertable or inserted through the at least one opening; and the at least one tuning element is arranged radially or at an angle to a peripheral side face of the at least one capacitive coupling element.

3. The high-frequency conductor system according to claim 1, further comprising:

at least one connector, which enables electrical contacting of the at least one cable-bound RF bushing from outside the high-frequency housing;

wherein the at least one cable-bound RF bushing is supported by the at least one connector and held in position within the accommodation space at a distance from the high-frequency housing.

4. The high-frequency conductor system according to claim 1, wherein:

at least one or all of the first, second, third and fourth coupling webs are formed integrally with the housing base and/or the housing wall and are a part thereof.

5. The high-frequency conductor system according to claim 1, wherein:

the housing base and/or the housing wall defines at least one recess;

the at least one recess is formed in a region of a peripheral side face of the at least one capacitive coupling element, reducing a capacitive coupling between the peripheral side face of the at least one capacitive coupling element and the high-frequency housing.

6. A high-frequency conductor system for use with a cable-bound RF bushing having a periphery and a propagation direction, the high-frequency conductor system comprising:

a high-frequency housing comprising a housing base, a housing cover disposed at a distance from the housing base, and a housing wall which extends peripherally between the housing base and the housing cover, the high-frequency housing providing an accommodation space therein;

the high frequency housing being structured to accommodate the cable-bound RF bushing within the accommodation space without galvanically contacting the cable-bound RF bushing;

a capacitive coupling element structured to be disposed on at least part of a periphery of the cable-bound RF bushing and to galvanically connect to the cable-bound RF bushing;

the capacitive coupling element comprising plural opposing end faces oriented transversely or perpendicularly to the propagation direction of the cable-bound RF bushing; and a coupling web galvanically connected to the high-frequency housing and at least in part projecting into the accommodation space;

the coupling web being arranged at a distance from at least one of the plural opposing end faces to thereby provide capacitive coupling between the high-frequency housing and the cable-bound RF bushing;

wherein capacitive coupling between the plural opposing end faces and the coupling web provides more than 50% of total capacitive coupling between the capacitive coupling element and the high-frequency housing.

7. The high-frequency conductor system according to claim 6, wherein:

the coupling web is formed integrally with the housing base and/or the housing wall and is a part thereof.

8. The high-frequency conductor system according to claim 6, wherein:

the housing base and/or the housing wall define at least one recess in a region of a peripheral side face of the capacitive coupling element, the recess reducing capacitive coupling between the peripheral side face and the high-frequency housing.

9. A high-frequency conductor system with at least one cable-bound RF bushing, comprising:

a high-frequency housing which comprises a housing base, a housing cover which is at a distance from the housing base, and a housing wall which extends peripherally between the housing base and the housing cover to form an accommodation space;

the at least one cable-bound RF bushing being arranged within the accommodation space of the high-frequency housing;

the at least one cable-bound RF bushing being galvanically separated from the high-frequency housing;

at least one capacitive coupling element arranged on at least part of a periphery of the at least one cable-bound RF bushing, the at least one capacitive coupling element being galvanically connected to the at least one cable-bound RF bushing;

the at least one capacitive coupling element comprising opposing end faces which are oriented transversely or perpendicularly to a propagation direction of the at least one cable-bound RF bushing; and at least one capacitive coupling web galvanically connected to the high-frequency housing and projecting into the accommodation space at least in part;

the at least one capacitive coupling web being arranged at a distance from at least one part of at least one of the opposing end faces of the at least one capacitive coupling element in order to generate a capacitive coupling between the at least one cable-bound RF bushing and the high-frequency housing via at least one of the opposing end faces;

wherein the at least one capacitive coupling element comprises a plurality of capacitive coupling elements arranged axially spaced apart on at least part of the periphery of the at least one cable-bound RF bushing; and wherein the at least one capacitive coupling web is arranged on one or both end faces of the plurality of capacitive coupling elements to generate a capacitive coupling between the at least one cable-bound RF bushing and the high-frequency housing via at least one of the end faces.

10. The high-frequency conductor system according to claim 9, further comprising:

at least one holding and positioning web, which projects at least in part into the accommodation space and is passed through by an accommodation opening over an entire thickness thereof in the propagation direction of the at least one cable-bound RF bushing;

the accommodation opening being further accessible at least in a lateral direction transverse to the propagation direction over an entire thickness of the holding and positioning web;

wherein the cable-bound RF bushing is mounted within the accommodation opening on the at least one holding and positioning web.

11. The high-frequency conductor system according to claim 10, wherein:

an insulating medium is also arranged between the at least one cable-bound RF bushing and the at least one holding and positioning web, the insulating medium galvanically separating the holding and positioning web and the at least one cable-bound RF bushing.

12. The high-frequency conductor system according to claim 11, wherein the insulating medium comprises:

(a) a dielectric layer at least on a part of the holding and positioning web on which the at least one cable-bound RF bushing is mounted; and/or (b) a dielectric layer at least on a part of the at least one cable-bound RF bushing which is mounted on the holding and positioning web; and/or (c) an insulating sleeve, which radially encloses the at least one cable-bound RF bushing at least in part in a region in which the at least one cable-bound RF bushing is mounted on the holding and positioning web.

13. The high-frequency conductor system according to claim 11, wherein:

the insulating medium comprises an insulating sleeve, which radially encloses the at least one cable-bound RF bushing at least in part in a region in which the at least one cable-bound RF bushing is mounted on the holding and positioning web; and the insulating sleeve:

(i) has an accommodation slit over an entire length thereof, into which the at least one cable-bound RF bushing is inserted; or (ii) consists of two sleeve halves which are movably interconnected on one face and in which the at least one cable-bound RF bushing is arranged, the two sleeve halves being clamped, clipped, screwed and/or glued to one another on another face thereof.

14. The high-frequency conductor system according to claim 13, wherein:

the insulating sleeve has at least one coding projection and/or at least one coding opening at least on part of a periphery thereof, which engages with at least one coding opening and/or at least one coding projection on the holding and positioning web.

15. The high-frequency conductor system according to claim 13, wherein:

the insulating sleeve has end faces and peripheral side faces, the end faces extending transversely or perpendicularly to the propagation direction, at least portions of the peripheral side faces being engaged with the holding and positioning web.

16. The high-frequency conductor system according to claim 13, further comprising:

a) a positioning element protruding beyond a cross section of the at least one cable-bound RF bushing is also arranged on the at least one cable-bound RF bushing, the insulating sleeve being positioned on the positioning element so as to be undisplaceable or only displaceable to a limited extent in the propagation direction of the at least one cable-bound RF bushing; or b) two positioning elements protruding beyond a cross section of the at least one cable-bound RF bushing are arranged on the at least one cable-bound RF bushing, the insulating sleeve being arranged between the two positioning elements so as to be undisplaceable or only displaceable to a limited extent in the propagation direction of the at least one cable-bound RF bushing.

17. The high-frequency conductor system according to claim 16, wherein:

a) the positioning element(s) is/are formed integrally with the at least one cable-bound RF bushing and is a part thereof; and/or b) the positioning element(s) is/are in the form of a positioning tab and only extend over part of the periphery of the at least one cable-bound RF bushing, or c) the positioning element(s) extend over the entire periphery of the at least one cable-bound RF bushing.

18. The high-frequency conductor system according to claim 16 wherein:

the at least one capacitive coupling element and/or the insulating sleeve and/or the positioning element(s) are connected centrally or eccentrically to the at least one cable-bound RF bushing.

19. The high-frequency conductor system according to claim 16 wherein a cross-sectional shape of the at least one insulating sleeve and/or of the at least one capacitive coupling element and/or of the positioning element(s) corresponds or approximates in a plan view to a square; or a rectangle; or an oval; or a circle; or a regular or irregular n-gon.

20. The high-frequency conductor system according to claim 10, wherein:

the accommodation opening within the holding and positioning web widens, conically, in a direction transverse to the propagation direction over the entire thickness in the direction of the high-frequency housing; and/or the holding and positioning web is formed integrally on the housing wall and/or on the housing base or on the housing cover; and/or the holding and positioning web projects sufficiently far into the accommodation space that the at least one cable-bound RF bushing is mounted centered in the accommodation space.

* * * * *